United States Patent [19]

Callaway

[11] 4,399,576

[45] Aug. 23, 1983

[54] FLOTATION MATTRESS INCORPORATING DRAIN/FILL VALVE

[75] Inventor: Milton A. Callaway, Medford, Oreg.

[73] Assignee: Simmons U.S.A. Corporation, Atlanta, Ga.

[21] Appl. No.: 235,222

[22] Filed: Feb. 17, 1981

[51] Int. Cl.[3] ..... A47C 27/08; F16K 15/20

[52] U.S. Cl. ..... 5/451; 137/223; 137/355.16; 137/355.28

[58] Field of Search ..... 5/451, 452, 450, 453, 5/454, 449; 137/223, 232, 355.16, 355.28

[56] References Cited

U.S. PATENT DOCUMENTS 1,116,105 11/1914 Norton ..... 137/232
3,849,814 11/1974 Ross ..... 137/223
4,189,798 2/1980 Vessey ..... 5/451
4,332,044 6/1982 Houk ..... 5/451

*Primary Examiner*—Alexander Grosz

[57] ABSTRACT

A flotation mattress is provided including a retractable valve for draining and filling said mattress. The valve includes an elongated neck portion including at least one port which may be extended from the mattress to facilitate the draining and filling operations. The valve may similarly be retracted within the mattress for storage. Upon retraction, the elongated neck portion defines a well a collapsible hose adapted to be secured to said at least one port for draining and filling the mattress may be stored. A cover is provided to protect the valve when recessed in the mattress.

3 Claims, 8 Drawing Figures

Fig. 1.
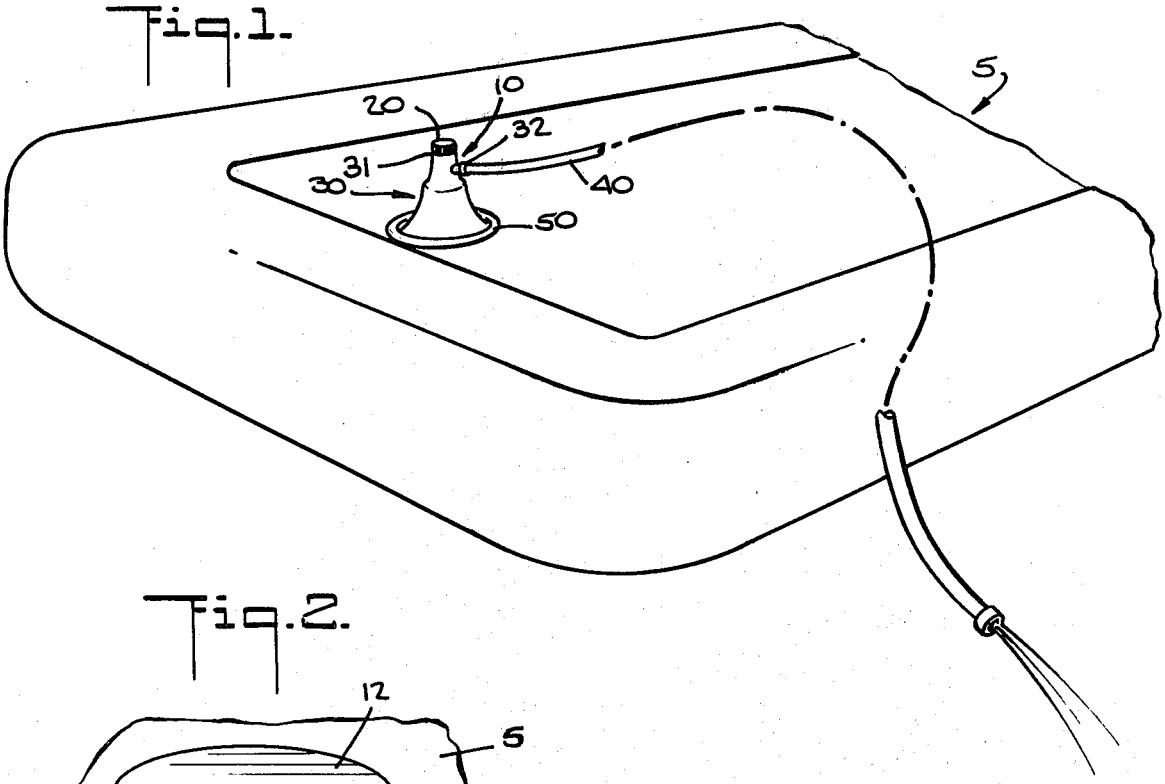
Fig. 2.
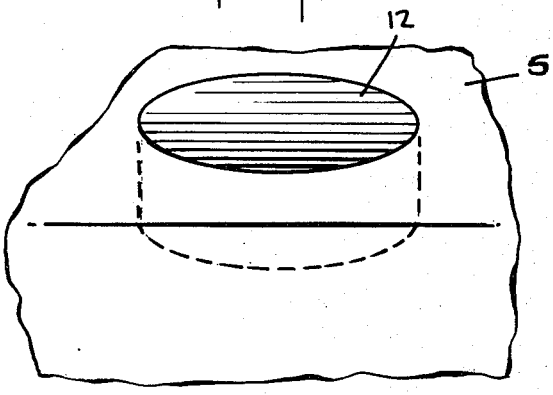
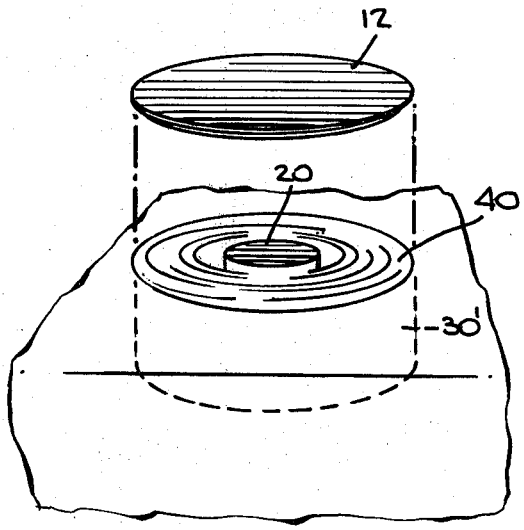
Fig. 3.
Fig. 4.
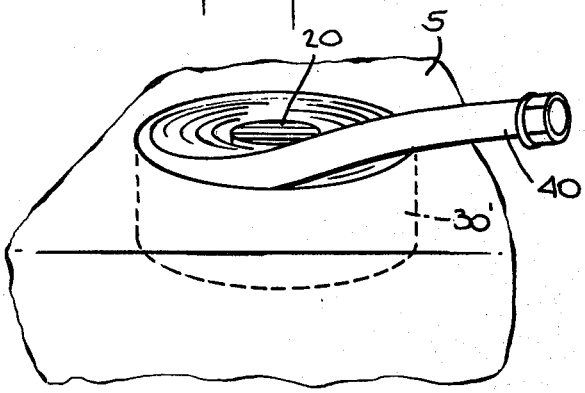

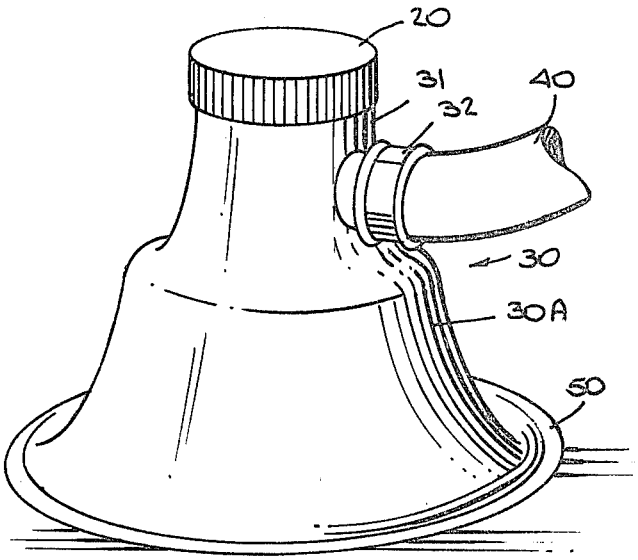
Fig. 5.
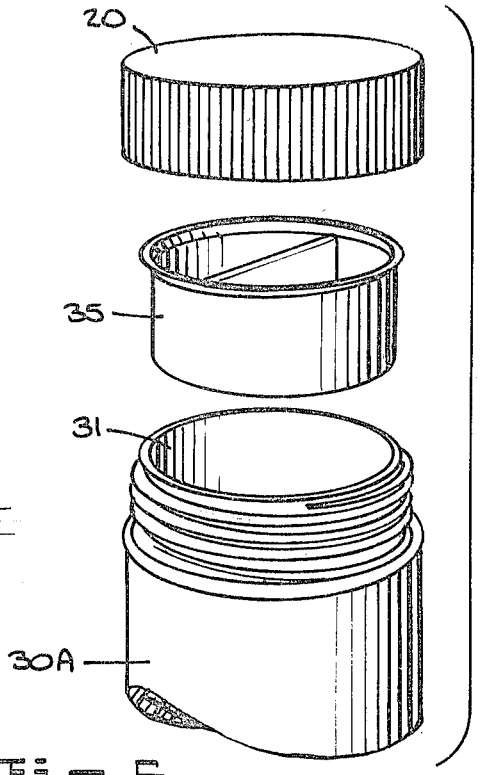
Fig. 6.
Fig. 7.
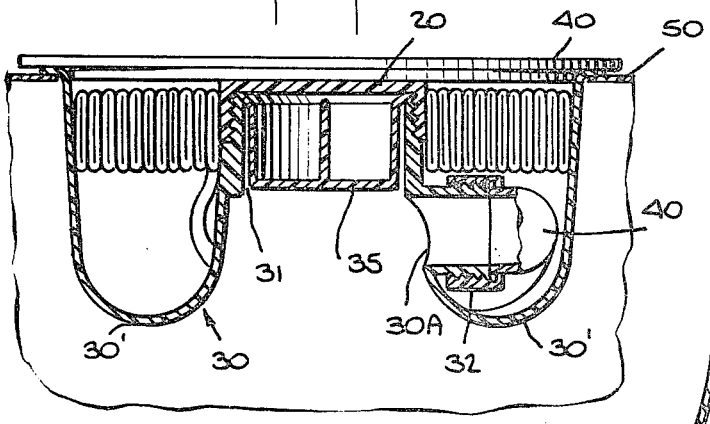
Fig. 8.
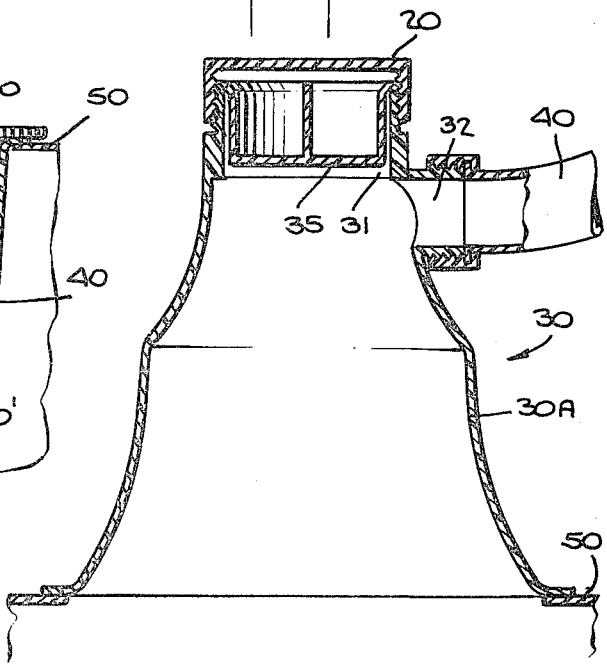

FLOTATION MATTRESS INCORPORATING DRAIN/FILL VALVE

BACKGROUND OF THE INVENTION

The present invention relates generally to a flotation mattress for use in a waterbed or other flotation product and, more particularly, to a flotation mattress which includes a drain/fill valve unit which incorporates a collapsable hose for use in draining and filling the flotation mattress.

Inherent in the use of any waterbed or flotation product is the problem associated with filling and draining the waterbag. Typically, waterbeds and other flotation products are located in residential bedrooms which are generally inaccessable to a convenient water supply. As such products require and contain substantial amounts of water, most owners resort to the use of a garden hose to fill and drain the product. Due to the nature of use of a garden hose, it typically must be cleaned prior to such use, lest dirt from the garden be deposited on the bedroom carpet. This inconvenience oftentimes results in a user's reluctance to adjust the firmness of the mattress and/or to replace water.

Against the foregoing background, it is a primary object of the present invention to provide a flotation mattress which incorporates a retractable valve for use in filling and draining the mattress.

It is another object of the present invention to provide a flotation mattress which includes a retractable, collapsible hose for use in filling and draining the mattress.

It is still another object of the present invention to provide a flotation mattress which includes a valve through which entrapped air may be eliminated.

SUMMARY OF THE INVENTION

To the accomplishment of the foregoing objects and advantages, the present invention, in brief summary, comprises a flotation mattress including a retractable valve for draining and filling the mattress. The valve includes an elongated neck portion having at least one port which may be extended from the mattress to facilitate the draining and filling operations. The valve may similarly be retracted within the mattress for storage. Upon retraction, the elongated neck portion deforms to form a well in which may be stored a collapsible hose adopted to be secured to the at least one port for draining and filling the mattress. The hose is preferably a woven nylon, collapsible hose which, when devoid of water, assumes a generally flat, cross-sectional, configuration.

BRIEF DESCRIPTION OF THE DRAWINGS

The foregoing and still other objects and advantages of the present invention will be more apparent from the following detailed explanation of the invention in connection with the accompanying drawings wherein:

FIG. 1 is a perspective illustration of a flotation mattress incorporating the drain/fill apparatus of the present invention;

FIGS. 2–4 are enlarged perspective views illustrating the drain/fill apparatus in a retracted position;

FIG. 5 is an enlarged perspective view illustrating the valve of the drain/fill apparatus in an extended position;

FIG. 6 is a breakaway view illustrating the valve of the drain/fill apparatus;

FIG. 7 is a sectional view of the drain/fill apparatus in a retracted position; and FIG. 8 is a sectional view of the drain/fill apparatus in an extended position.

DESCRIPTION OF THE PREFERRED EMBODIMENTS

The drain/fill apparatus of the present invention, referred to generally by reference numeral 10, is shown schematically in FIG. 1 forming an integral part of a flotation mattress 5. Drain/fill apparatus 10 includes a filler cap 20 which is threadably secured to an upper port 31 of valve 30. Valve 30 is retractable and may be extended outwardly into an extended "ready" position from mattress 5 as depicted in FIGS. 1 and 5. A collapsible hose 40 is threadably connected to a side port 32 on the valve 30. Valve 30 is secured to mattress 5 by a heat seal 50 around its periphery.

FIGS. 2–4 and 7 illustrate the manner in which the valve 30 may be retracted within mattress 5 that it is flush with the surface of the mattress 5 so as to be concealed during use. Valve 30 may be fabricated from either a thermoplastic or thermoset material, preferably vinyl or rubber, and includes an elongated neck portion 30A. Elongated neck portion 30A permits valve 30, when retracted within mattress 5, to form a containment well 30', as shown in FIG. 7, which permits storage of collapsible hose 40. Collapsible hose 40 is preferably fabricated from a woven nylon material and, when drained of water, assumes a generally flat cross-sectional configuration for ease of storage. It has been found that such woven nylon hoses 40 are extremely pliable and occupy minimal space when stored. As shown in FIG. 7, during storage, hose 40 assumes a relatively flat cross sectional configuration and thus may be wrapped around the cap 20 and upper neck portion of valve 30.

FIGS. 2–4 illustrate the manner in which the hose 40 is wrapped around cap 20 within well 30' during storage of the hose 40. As shown in FIGS. 2–3, a cover 12 is provided which, when valve 30 is retracted, seats over well 30' by friction fit or, if desired by a threaded fit, to completely conceal the drain/fill apparatus 10.

FIGS. 5–6 and 8 illustrate valve 30 in an extended, "ready" position for use during the fill/drain operation. As shown in FIG. 5, hose 40 is threadably connected to side port 32 and is used for draining and/or filling the mattress 5.

As shown in FIG. 6, an insertable seal 35 is provided within the upper top port 31 of valve 30 to insure against leakage of water during use. Top port 31 is provided to permit the passage of air during the drain and fill operations and may also be used to "burp" the mattress, i.e. to remove entrapped air subsequent to the fill operation.

It will be appreciated that in, actual use in order to fill or drain the mattress 5, the homeowner need only remove cover 12, retract the hose 40 from well 30', physically extend the valve 30 to an extended position and, after unwinding the hose 40, attach it to an external source of water or drain depending on the operation desired. To provide for the passage of entrapped air, filler cap 20 and seal 35 would be removed. Upon completion of the operation, the water would then drained out of collapsible hose 40 permitting it to assume a generally flat cross-sectional configuration. Valve 30 would then be withdrawn into mattress 5, cap 20 and seal 35 replaced and the hose 40 wrapped about cap 20 in well 30'. The cover 12 would then be placed over the drain/fill apparatus 10.

Having thus described the invention with particular reference to the prefered forms thereof, it will be obvious that various changes and modifications may be made therein without departing from the spirit and scope of the invention as defined in the appended claims.

What is claimed is:

1. A flotation mattress comprising valve means retractably secured thereto, said valve means including a resilient neck portion and a valve portion secured to said neck portion, said valve portion including a vertical top port and a horizontal side port, said neck portion and said valve portion defining an annular containment well beneath the surface of said flotation mattress, a collapsible hose wrapped about said valve portion and within said containment well, said hose being connected to said horizontal side port and wrapped about said valve portion above said side port.

2. A flotation mattress as defined in claim 1 including a cap secured to said top port.

3. A flotation mattress as defined in claim 1 including a cover secured thereto which covers said valve means and containment well.

* * * * *